US006082960A

United States Patent [19]

Fandrey et al.

[11] Patent Number: 6,082,960

[45] Date of Patent: Jul. 4, 2000

[54] REGENERATIVE PUMP

[75] Inventors: Peter Fandrey, Glückstadt; Gudrun Schulz, Itzehoe, both of Germany

[73] Assignee: Sterling Fluid Systems GmbH, Itzehoe, Germany

[21] Appl. No.: 09/029,645

[22] PCT Filed: Aug. 29, 1996

[86] PCT No.: PCT/EP96/03806

§ 371 Date: Feb. 26, 1998

§ 102(e) Date: Feb. 26, 1998

[87] PCT Pub. No.: WO97/08461

PCT Pub. Date: Mar. 6, 1997

[30] Foreign Application Priority Data

Aug. 30, 1995 [DE] Germany ..... 295 13 904 U

[51] Int. Cl.[7] ..... F04D 5/00

[52] U.S. Cl. ..... 415/55.1; 415/55.5; 415/200; 415/214.1

[58] Field of Search ..... 415/55.1, 55.2, 415/55.3, 55.4, 55.5, 55.6, 55.7, 200, 214.1

[56] References Cited

U.S. PATENT DOCUMENTS

| | | | |
|---|---|---|---|
| 2,282,569 | 5/1942 | Fabig | 103/96 |
| 3,440,968 | 4/1969 | Jensen | 103/108 |
| 4,390,317 | 6/1983 | Lehmann et al. | 415/143 |
| 4,842,480 | 6/1989 | Jensen et al. | 415/199.1 |
| 4,877,372 | 10/1989 | Jensen et al. | 415/214.1 |
| 5,318,403 | 6/1994 | Kajiwara et al. | 415/214.1 |

FOREIGN PATENT DOCUMENTS

| | | | |
|---|---|---|---|
| 0 045 483 A2 | 2/1982 | European Pat. Off. | F04D 9/04 |
| 0442070 | 8/1991 | European Pat. Off. . | |
| 0 588 258 A1 | 3/1994 | European Pat. Off. | F04D 29/44 |
| 1473699 | 3/1967 | France . | |
| 1 653 782 | 7/1971 | Germany . | |
| 36 29 123 A1 | 3/1988 | Germany | F04D 29/42 |
| 968511 | 9/1964 | United Kingdom . | |
| 94/23211 | 10/1994 | WIPO . | |
| WO 97/08461 | 3/1997 | WIPO | F04D 5/00 |

*Primary Examiner*—Edward K. Look
*Assistant Examiner*—Richard Woo
*Attorney, Agent, or Firm*—Alix, Yale & Ristas, LLP

[57] ABSTRACT

Side-channel centrifugal pump in sectional construction, the stage packs of which comprise a suction connector (6), a pressure connector (7), a vane (10) and a casing shell element (8, 9). In order to reduce the structural complexity, the suction and pressure connectors (6, 7) are formed as sheet-metal parts and are disposed in an annular casing shell element (8, 9). The centering of the suction and pressure connectors (6, 7) is expediently effected from the shaft.

16 Claims, 2 Drawing Sheets

17
18

1
2
3
4
5
6
7
8
9
10
11
12
13
14
15
16
17
18
19
X

REGENERATIVE PUMP

CROSS-REFERENCE TO RELATED APPLICATIONS

This is the national stage of International Application Ser. No. PCT/EP96/03806 filed Aug. 29, 1996.

BACKGROUND OF THE INVENTION

In side-channel pumps, it is necessary to maintain a tight play between the vane and the surrounding casing parts. If the gap becomes too large, the leakage flows within the pump increase and pumping capacity and effectiveness decline. Since the vanes must also be prevented, as far as possible, from running up against the casing parts, this means that those casing parts of the pump which enclose the vane, and the vane itself, must be accurately centred one to another and must be set perpendicular to the shaft. Finally, care should be taken in side-channel pumps to ensure that both the vane and the casing exhibit high strength characteristics, since side-channel pumps, in contrast to normal-intake pumps, can achieve many times higher pressures given equal pump dimensions and rotation speeds. This is particularly true of sectional pumps having a plurality of stages, in which very high pressures are obtained with just a relatively low number of stages. All these aspects have hitherto resulted in the casing parts which enclose the vane generally being constructed as metallic castings in which the interacting faces are worked with tight production tolerances. Although a pump of similar type, namely a peripheral pump, has been disclosed (GB-A 968 511), in which all pump casing parts are formed from sheet metal, this is only conceivable where the requirements in terms of trueness of running and efficiency are very low.

SUMMARY OF THE INVENTION

The object of the invention is to reduce the production complexity in side-channel centrifugal pumps of the type stated in the introduction, whilst maintaining a high level of efficiency. The solution according to the invention consists in the suction and pressure connectors of at least one stage pack being formed as sheet-metal parts and being disposed in an annular casing shell element.

The fact that the casing parts enclosing the vane are deep-drawn and punched as simple sheet-metal parts or are spatially formed in a similar fashion and the casing shell elements which reach over them are configured as simple annular parts means that the structural complexity is very low. The invention is based on the recognition that the dimensional accuracy which is now available for sheet-metal parts by deformation technology is sufficient, under certain preconditions, for such sheet-metal parts to be used as casing parts for side-channel pumps. The precondition for this is, however, that the sheet-metal parts should be of such simple design that a flat plate can be used as the original blank, which is then deep-drawn in the desired manner.

Although it is known (EP-A 588 258), in a normal-intake centrifugal pump, to provide a disc-shaped annular element of a stepped casing pack made from formed sheet-metal, there are no fundamental accuracy requirements placed upon this part, whereas those inner casing parts which interact with the impeller are traditionally configured as castings.

Furthermore, in a normal-intake centrifugal pump (DE-A 36 29 123) on which no fundamental efficiency requirements are placed and in which the distributor of the individual pump stages is not therefore particularly matched in shape to the impeller, it is known to make this distributor from sheet-metal; yet, because of the different accuracy requirements, this cannot be a model for side-channel centrifugal pumps.

The casing shell elements of successive stages can be centred at the ends in a known fashion one to another and in relation to the end casing parts. They can also centre the suction and pressure connectors at their outer periphery. According to the invention, however, an embodiment is preferred in which the suction and pressure connectors in the casing shell elements exhibit radial play and are centred from the shaft. The radial play between the suction and pressure connectors and the casing shell elements is expediently only present during assembly, whereas, once assembly is completed and they have been centred by the shaft, the suction and pressure connectors are firmly clamped between the casing shell elements.

In an advantageous embodiment, the centering from the shaft is realized by virtue of the fact that in each pressure connector there is disposed a bearing bush carrier, which is centred on the outer periphery of an assigned bearing bush seated on the shaft. The suction connector can then be centred in each case by the adjacent pressure connector of the preceding stage, in that its inner bore reaches over the bearing bush carrier or bearing bush of the latter. Just like the vane itself, the casing parts enclosing the vane are therefore centred by the shaft. The shaft, in turn, is centred in relation to the outer casing. The bearing bush carriers can be moulded onto the pressure connectors by drawing or another non-cutting deformation process; they can also however be welded to them. With a view to fitting accuracy, they are expediently worked externally and internally. The latter also applies to the centering bore of the suction connector, whereas the outer diameters of the suction and pressure connectors do not generally need to be worked.

The gap accuracy between the suction and pressure connectors on the one hand and the vane on the other hand, where these parts are formed from sheet metal, can be promoted by the fact that, according to the invention, the suction connector is configured wholly, or at least in its region interacting with the vane, as a flat plate. This casing part, which interacts with the vane over a particularly large area, is consequently not prone to distortion. The entire radial outer boundary of the delivery chamber is assigned here to the pressure connector, which is anyway subject to greater deformation and interacts with the vane with a smaller surface component. This offers firstly the advantage that those faces of the connectors for which relatively large production tolerances have to be expected interact with the vane to a lesser extent, so that under the given deformation conditions a vane play is attained which is as low as possible in overall terms.

A further advantage derives from the following association. Since the pressure casing part is not sharp-edged but passes in curved progression from its peripheral surface into its flange, which is clamped between the casing shell elements, a peripheral groove is formed in the region of this curvature on the outer periphery of the wheel, which peripheral groove is undesirable in principle and is bounded in cross-section by this curvature and the suction connector. If, as usual, the radially outer boundary of the delivery chamber were to be assigned partly to the suction connector and partly to the pressure connector, this groove would be twice as large due to dual-sided curvature; accordingly, the leakage flow would be at least twice as great. The fact that the work chamber is bounded in the radially outward direction solely by the pressure connector, whilst the suction connector is flat, means that this leakage current is minimized. Although even this leakage flow can even be prevented by machine-working the inner diameter of the pressure connector, the invention seeks specifically to avoid this complexity and, for this reason, preferably does without it.

The sealing against the ambient atmosphere is expediently executed between adjacent casing shell elements, since their relatively thick wall dimensions are able to accommodate an O-ring seal, for example, without difficulty.

A simple and effective option for ensuring the spacings between the individual stage packs can be achieved by the suction and pressure connectors being axially fixed between the casing shell elements.

The associated suction and pressure connectors should be fixed in relation to one another in the peripheral direction as well. According to the invention, this is most easily realized by punching a recess into the periphery of one of these parts, a projection of the other part engaging into this recess. This arrangement is expediently situated within the marginal region of the suction and pressure connectors, which region lies between the end faces of adjacent casing shell elements. For example, a narrow cut-out can be punched in the periphery of the suction connector, into which cut-out there engages a lug which is notched out from the periphery of the pressure connector. These moulded elements require no additional manufacturing effort, since they can be fitted simultaneously with the other shaping procedure for the sheet-metal parts.

Where particularly high requirements are placed on the seal-tightness of the pump, according to the invention the whole of the stage packs can be disposed in a surrounding pot, which is expediently also provided with suction and pressure sockets, only this pot needing to be sealed against the atmosphere. A single sealing point on the casing will generally suffice for this purpose. Any leaks between the stages and the interior of the surrounding pot can generally be neglected, so that there is no need for a special seal between the casing shell elements. Where required, such seals can however additionally be fitted.

The casing shell elements of the stage packs can be axially braced using the fastening elements of the surrounding pot.

BRIEF DESCRIPTION OF THE DRAWINGS

The invention is explained in greater detail below with reference to the drawing, which depicts advantageous illustrative embodiments and in which.

DETAILED DESCRIPTION OF THE INVENTION

Figures 1, 2:
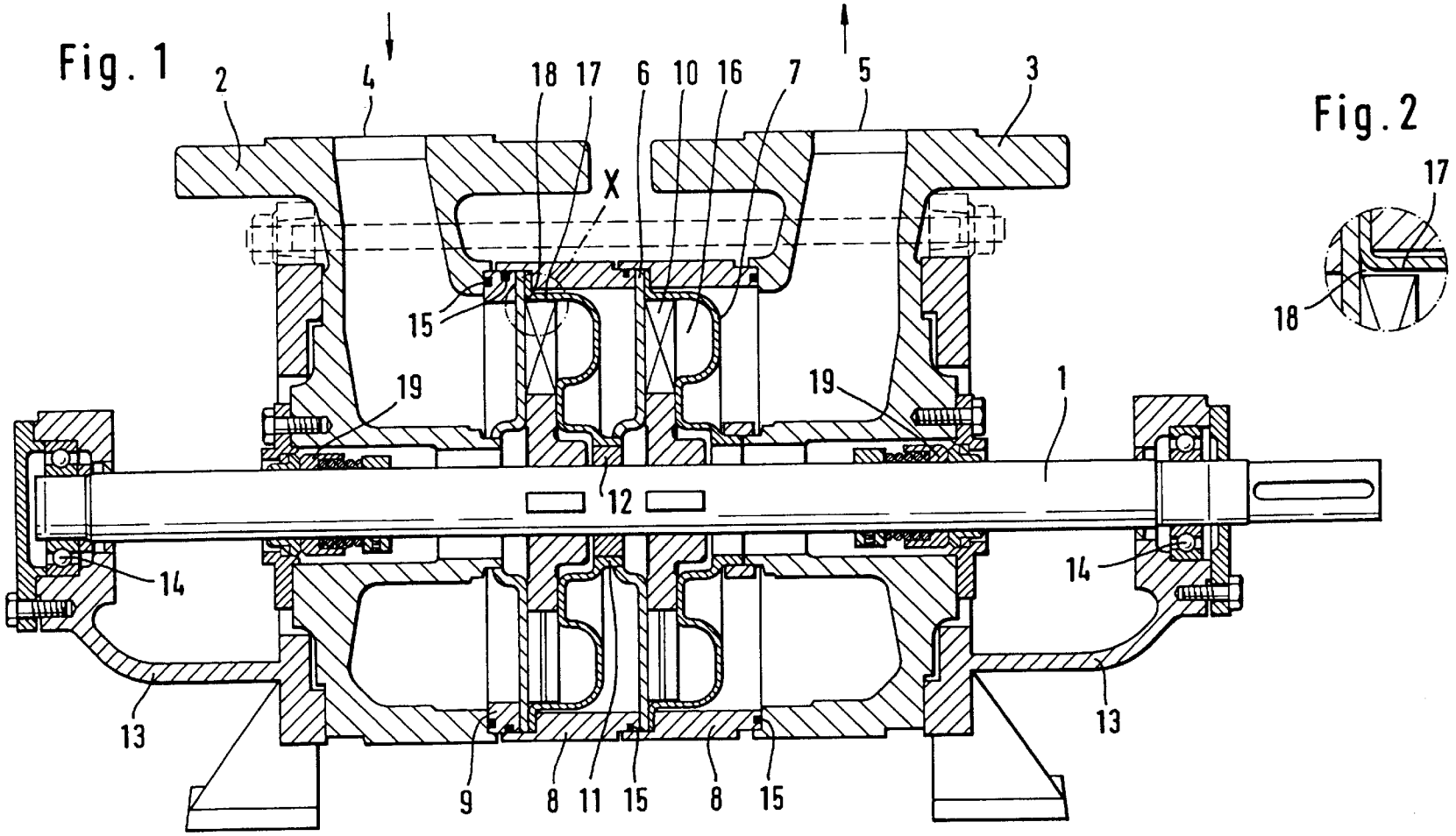
FIG. 1 shows a cross-section through a first embodiment.
FIG. 2 shows an enlarged detail of FIG. 1.

The casing of the pump represented in FIG. 1 is closed at the ends by the pump suction casing 2 with suction sockets 4 and by the pump pressure casing 3 with pressure sockets 5. Connected to these are bearing brackets 13 with ball bearings 14, which support and centre the shaft 1. The suction and pressure casings 2, 3 also contain the shaft seals 19.

Clamped between the pump suction and pressure casings 2, 3 are cylindrical casing shell elements 8, which are centred with one another and with the pump pressure casing 3 directly and with the pump suction casing 2 via an additional centering ring 9 and are mutually sealed by O-rings 15.

Clamped between the casing shell elements 8, and between a casing shell element 8 and the ring 9, there are respectively the margins of a suction connector 6 and of a pressure connector 7. They are thereby axially positioned and fixed. They form, together with the associated vane 10 and a casing shell element 8, a respective stage pack.

The outer margins of the suction and pressure connectors 6, 7 are clamped between end faces of the casing shell elements 8, 9 and, as long as this clamping is not yet effective during assembly, enjoy play relative to the associated inner diameter of the casing shell elements. The respectively outermost suction and pressure connectors are centred by the hub parts of the suction and pressure casings 2, 3. The suction and pressure connectors 6, 7 located therebetween are centred from the shaft 1 via a bearing bush 12. For this purpose, the pressure connector of the stage represented on the left in the drawing is welded to a bearing bush carrier 11, which interacts in a centering fashion with the outer periphery of the bearing bush 12. The inner diameter of the suction connector 6 of the stage represented on the right is worked such that it fits the outer diameter of the bearing bush carrier 11 and is centred by the latter.

The pressure connectors 7 are formed such that they fully form the side channel 16 and the radially outer boundary 17 of the delivery chamber. In contrast to this, the suction connector 6 is configured wholly, or only with the exception of its radially innermost region which does not interact with the vane, as a flat plate and is therefore not subject to distortion. It is additionally envisaged that the suction connector 6 consists of relatively thick material (for example, 3 mm) so as to offer particularly good preconditions for a consistently flat design. The pressure connector 7 can be somewhat thinner by comparison (for example 2 mm).

At the point 18 at which the two connectors 6, 7 meet at the outer periphery of the work chamber, the curved transition of the cylindrical part 17 of the pressure connector 7 into its radial flange region gives rise to a groove, which is particularly clearly discernible in the enlarged representation of FIG. 2 and which is bounded in a roughly triangular shape by the flat surface of the suction connector and the curved surface of the pressure connector and in which an undesirable return-flow of pumping medium from cell to cell is possible. If, as is otherwise usual, the radially outer boundary of the delivery chamber were to be disposed in the vane region on the suction connector 6 and in the side-channel region on the pressure connector 7, then the cross-section of this groove would double, since the curved boundary would then appear on both sides. This is prevented—as a further advantage—by the flat design of the suction connector 6.

Figure 3:
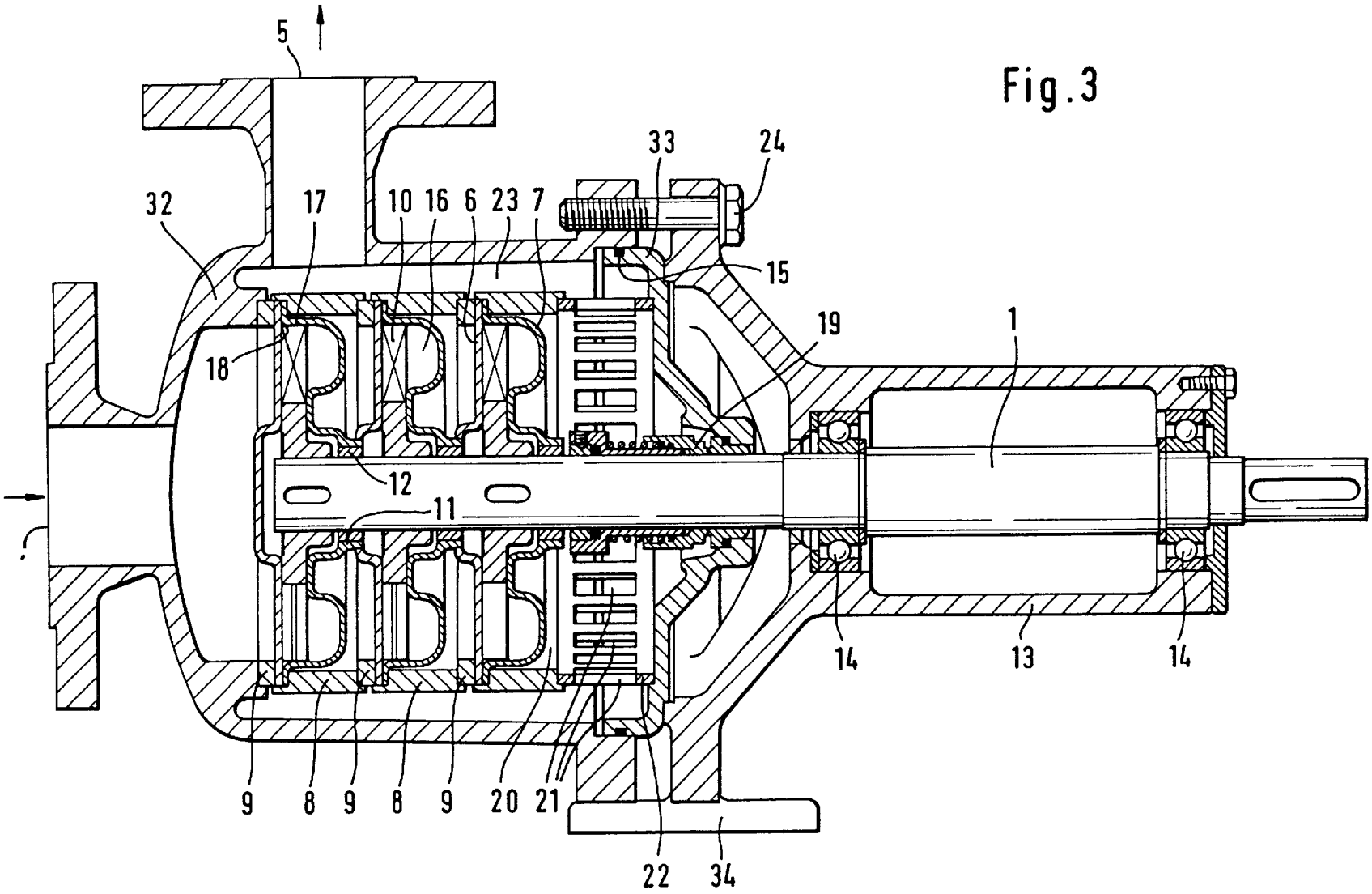
FIG. 3 shows a second embodiment.

Those parts of the second embodiment, represented in FIG. 3, which are identical with or correspond to the above-described parts of the first embodiment are provided with identical reference numbers.

The pot casing 32 is provided both with suction sockets 4 and pressure sockets 5. It forms the pump casing jointly with the casing cover 33, which contains the shaft seal 19. The casing is held by the bearing carrier 13 with foot 34 and ball bearings 14, which hold the shaft 1 in suspension-mounting.

The outer casing 32, 33 is axially clamped together by fastening elements 24. The casing shell elements 8 and the annular elements 9, which latter are provided in this example in respect of each stage pack, as well as a transfer ring 22, are thereby axially clamped together. Seals between the casing shell elements 8, 9 and the adjoining casing parts are not provided. The outward sealing is provided here solely by an O-ring 15 between the outer casing parts 32, 33.

Emanating from the suction socket 4, the medium flows through the pump in the axial direction through the stages and into the pressure chamber 20 of the last side-channel stage. From here it flows through openings 21 in the transfer ring 22, which assists in the centering and axial fixation of the casing shell elements, into the space 23 between the pot 32 and the casing shell 8, 9 and finally leaves the pump through the pressure socket 5.

For an explanation of the suction and pressure connectors 6, 7 and their details, reference is made to the description of the first illustrative embodiment.

The casing shell elements are constructed many times thicker than the sheet-metal parts 6, 7.

What is claimed is:

1. A multistage side-channel centrifugal pump comprising:

a plurality of stage packs, each said stage pack including a suction connector, a pressure connector, a vane and at least one annular casing shell element having axially opposed end faces, and a shaft, wherein said suction and pressure connectors are formed as sheet-metal parts having outer margins and said suction and pressure connectors are disposed with said outer margins between the end faces of said annular casing shell elements and at least one said suction connector and at least one said pressure connector have radial play within said annular casing shell elements and are centered from said shaft.

2. The side-channel centrifugal pump according to claim 1, characterized in that in said at least one pressure connector there is disposed a bearing bush carrier with centering on the outer periphery of a bearing bush and in that an inner bore of said at least one suction connector is centered on the bearing bush carrier of the preceding stage.

3. The side-channel centrifugal pump according to claim 1, characterized in that in the pressure connector there is disposed a side channel, a pass-through opening for the pumping medium and a radial outer boundary of a delivery chamber, and the suction connector is configured, in its region interacting with the vane, as a flat plate.

4. The side-channel centrifugal pump according to claim 1, characterized in that the sealing of the stage packs against the ambient atmosphere is disposed at an outer margin of said suction connector and said pressure connector between the annular casing shell elements.

5. The side-channel centrifugal pump according to claim 1, characterized in that the suction and pressure connectors are axially fixed between the annular casing shell elements.

6. The side-channel centrifugal pump according to claim 1, characterized in that the suction and pressure connectors are fixed relative to each other in the peripheral direction by tongue-and-groove connection.

7. The side-channel centrifugal pump according to claim 1, characterized in that the stage packs are disposed in a surrounding pot having suction and pressure sockets and the annular casing shell elements are of seal free configuration.

8. The side-channel centrifugal pump according to claim 7, characterized in that the annular casing shell elements of the stage packs are clamped together by at least one fastening element of the surrounding pot.

9. The side-channel centrifugal pump of claim 1, wherein said at least one pressure connector includes a bearing bush carrier centered on the outer periphery of a bearing bush and an inner bore of said at least one suction connector is centered on the bearing bush of the preceding stage.

10. A multistage side-channel centrifugal pump comprising:

a casing including a pump suction casing with at least one suction socket, said suction casing including a bearing bracket including a bearing for supporting and centering one end of a shaft, an axially spaced pump pressure casing with at least one pressure socket, said pressure casing including a bearing bracket including a bearing for supporting and centering an axially opposed end of said shaft and at least one annular casing shell element centered from said suction casing, said casing shell element having oppositely disposed end faces, and a plurality of stage packs, each stage pack including a sheet-metal suction connector, a sheet-metal pressure connector and a vane centered on and mounted to said shaft, said connectors having outer margins, wherein at least one said suction connector and at least one said pressure connector have centering means interactive with said shaft and are disposed with radial play in the casing shell element with said outer margins positioned between said end faces and are centered from the shaft and clamped between said end faces.

11. The multistage side-channel centrifugal pump of claim 10, wherein said at least one pressure connector comprises a bearing bush carrier centered on the outer periphery of a bearing bush and said at least one suction connector comprises an inner bore centered on said bearing bush carrier.

12. The multistage side-channel centrifugal pump of claim 10, wherein said at least one pressure connector comprises a bearing bush carrier centered on the outer periphery of a bearing bush and said at least one suction connector comprises an inner bore centered on said bearing bush.

13. The multistage side-channel centrifugal pump of claim 10, wherein said pressure connector comprises a pass-through opening for the pumping medium and a radial outer boundary of a delivery chamber and said suction connector is configured, in its region interacting with the vane, as a flat plate.

14. The multistage side-channel centrifugal pump of claim 10, wherein the sealing of the inside of the pump against the ambient atmosphere is disposed in the region of said shell casing elements.

15. The multistage side-channel centrifugal pump of claim 10, wherein said suction and pressure connectors are axially fixed between said casing shell elements.

16. A method for assembling a pump of the multistage side-channel centrifugal type comprising a shaft, a casing including a pump suction casing, said suction casing including a bearing bracket including a bearing for supporting and centering one end of said shaft, an axially spaced pump pressure casing, said pressure casing including a bearing bracket including a bearing for supporting and centering an axially opposed end of said shaft and a plurality of annular casing shell elements having oppositely disposed end faces, and a plurality of stage packs, each said stage pack including a suction connector, a pressure connector and a vane, said suction and pressure connectors having outer margins, at least one said suction connector and at least one said pressure connector having centering means interactive with said shaft, said assembly method comprising:

positioning said at least one pressure connector and said at least one suction connector on said shaft with said outer margins between said end faces whereby said at least one pressure connector and said at least one suction connector are centered from said shaft and have radial play relative to said annular shell casing elements, and bracing said annular casing shell elements in an axial direction whereby said at least one pressure connector and said at least one suction connector are fixed relative to said annular casing shell elements.

* * * * *